US005397032A

United States Patent [19]

Landers

[11] Patent Number: 5,397,032

[45] Date of Patent: Mar. 14, 1995

[54] DROP-IN BEVERAGE AND ICE DISPENSER

[75] Inventor: Jerry L. Landers, Sellersburg, Ind.

[73] Assignee: SerVend International, Inc., Sellersburg, Ind.

[21] Appl. No.: 64,439

[22] Filed: May 21, 1993

[51] Int. Cl.[6] ..... B67D 5/62

[52] U.S. Cl. ..... 222/146.6

[58] Field of Search ..... 222/129.1–129.4, 222/146.1, 146.6; 62/389–400

[56] References Cited

U.S. PATENT DOCUMENTS

| | | | |
|---|---|---|---|
| 3,331,536 | 5/1966 | Lorenzo . | |
| 4,175,292 | 11/1979 | Morrison | 4/187 A |
| 4,651,538 | 3/1987 | Bull et al. . | |
| 4,678,104 | 7/1987 | Pritchett | 222/146.6 |
| 4,958,505 | 9/1990 | Swanson . | |
| 5,080,261 | 1/1992 | Green . | |
| 5,249,710 | 10/1993 | Hassell et al. | 222/146.6 |
| 5,335,819 | 8/1994 | Martin | 222/146.6 |
| 5,343,716 | 9/1994 | Swanson et al. | 222/146.6 X |

FOREIGN PATENT DOCUMENTS

| | | | |
|---|---|---|---|
| 406297 | 8/1967 | Australia | 222/146.6 |
| 80253 | 6/1983 | European Pat. Off. | 222/146.6 |

*Primary Examiner*—Andres Kashnikow
*Assistant Examiner*—Kenneth R. DeRosa
*Attorney, Agent, or Firm*—James Creighton Wray

[57] ABSTRACT

Out-turned upper edge portions of cabinet walls support a drop-in dispenser on edges of a counter top opening. A trim ring overlies and covers the out-turned edge portions. A tower with valves extends upward from the cabinet, and an anchor extends downward inside the cabinet walls for supporting the tower. A large curved drain pan extends over the trim ring beneath valves on the tower. A drain tube at the back of the drain pan extends straight downward to a drain opening at the bottom of the dispenser. The drain tube is straight and uninterrupted and has a large diameter. A channel extends from the front to the back of the base. An ice storage bin with a cold plate at its bottom is installed in the cabinet, and inlet fittings from the cold plate extend downward and rearward in the channel for ease of connection of liquid lines when the dispenser is tipped on its back, and for preventing damage to the fittings. The ice bin drain and the ice pan drain open in the widened rear of the channel from non-clogging large straight tubes. A T-shaped smooth plastic runner is mounted in the front center of the base, and two inward angled runners are mounted near rear corners of the base for supporting the unit on flat surfaces. Vertical conduits extend from the top to the bottom corners of the base for inserting non-cooled syrup lines or electrical lines. The drain pan, splash plate and ice door are readily removable without tools.

19 Claims, 2 Drawing Sheets

DROP-IN BEVERAGE AND ICE DISPENSER

BACKGROUND OF THE INVENTION

Drop-in ice bin beverage dispensers are widely used in restaurants. The dispensers have a cabinet which is mounted within a opening in a counter top. An ice bin is insulated from walls of the cabinet. A tower extends upward from the back of the cabinet, and drink-dispensing valves are mounted on the tower. An ice pan under the valves catches excess ice and overflows from the valves as cups are filled with drinks. The tower and drain pan cover the rear of the ice bin and a sliding or rotating door covers the remainder of the ice bin. When the door is raised, ice can be scooped from the ice bin. The bottom of the ice bin is an aluminum cold plate through which beverage cooling pipes pass. The pipes extend downward below the cold plate so that syrup and soda water supply tubes may be connected to ends of the pipes.

Pipes extend upward as drink lines, syrup lines and carbonated water lines, which are connected to mixer valves for mixing the cold syrup with the cold carbonated water when the valves are opened.

Drop-in units have several problems which have long existed. A need for a solution of those problems has long existed without resolution.

One of the important outstanding problems is the supporting of the heavy filled ice bin and cold plate with the trim ring which surrounds the dispenser and rests on the edges of the opening in the counter top.

When the dispenser is removed for refurbishment, inspection or replacement, an installer pushes a screwdriver beneath the trim ring and begins the lifting of the dispenser by prying the trim ring with the screwdriver. The result is a damaged trim ring. Since the trim rim is an integral part of the cabinet it cannot be replaced. A dispenser with a damaged trim ring is often valueless. A problem has long existed in how to keep trim rings flush with counter tops while permitting removal of the dispenser without permanently damaging the trim rings and the dispensers.

Another problem with the drop-in dispensers is the location and positioning of inlet fittings for the cold plate. The inlet fittings have to be accessible for connection to syrup tubes and carbonated water tubes. The accessibility of those fittings makes them susceptible to damage. Often the fittings extend downward or below the base. When fittings terminate downward, tube clamps and tubes project straight downward and may transfer shock or bending pressure to the fittings. When the fittings are positioned near the rear of the base, and when the drop-in dispenser is lifted and tipped backwards for access to the fittings, the fittings are damaged. Bent or split fittings are unrepairable. A single damaged fitting results in the loss of a cooling circuit through the cold plate. Several damaged fittings render the drop-in dispenser inoperative and unrepairable. That problem has long existed. How to provide the fittings in such a way that the danger of damage to the fittings is avoided has been an ongoing problem.

Another problem of long standing with drop-in dispensers is that drains tend to clog.

Another problem of the existing drop-in dispensers is that the tower is connected to the top of the cabinet, making a weak connection between the tower and the cabinet top, and providing a loose tower cabinet joint. Loose tower joints allow accumulation of dirt and allow valve body movement when pushing levers or switches.

Another problem of existing drop-in dispensers is the requirement of tools to disassemble upper parts of the dispensers after they are mounted in place so that the upper parts may be removed for cleaning the ice bin drain tray and cover. The requirement of tools provides difficulty and enlarges time requirements for cleaning.

These and other problems of drop-in dispensers have remained without solution.

SUMMARY OF THE INVENTION

The present invention solves the existing problems of the prior art drop-in dispensers by providing a separate direct support for the drop-in container on the counter top surrounding the opening, and by providing a downward extending anchor for the tower and a front-to-back channel in the base of the dispenser in which inlet fittings extend downward and rearward near the front of a channel for easy access, by providing straight large drain tubes which open into the rear of the channel from the drain pan and ice bin and by providing disassembly without tools of parts for cleaning and inspection.

The new drop-in units have been created for long service. The new drop-in dispensers avoid damage during installation, service, transport and refurbishing due to an innovative construction. The new drop-in dispensers are easy to install, are resistant to damage during transport and are created for ease of service and refurbishing.

The inlet fittings are curved back and recessed into the bottom of the unit, making the new drop-in easier to move, service, store or install. A channel is recessed into the bottom of the bin so water and syrup lines more easily fit under the drop-in. The recessed design also helps protect the fittings from damage during transport, installation and removal and during tipping up on its back for installation or inspection, which could result in the loss of a circuit on the cold plate.

Three spaced and angularly related smooth plastic runners allow the drop-in to slide easily across the floor or counter top, whenever the unit needs to be moved.

Vertical conduit tubes extend from the bottom to the top for non-cooled syrup or electrical lines.

The new features make the drop-in units sturdy, simple to service, resistant to damage during transportation, installation and removal, and economical to refurbish.

The large, curved merchandiser is backlit and reversible to attractively showcase graphics to customers.

The manifold is foam insulated to help ensure the even flow of consistently cold drinks.

The tower is sturdier. The sheet metal of the tower is brought down through the trim ring and is anchored to the sides of the cabinet. It is not just fastened to the rim.

The large, curved drain pan has the capacity for 4 lbs. of scrap ice.

Easy access is provided to the straight and large three-quarter inch ID pan drain which is straight for uninterrupted, high volume drainage. There are no elbows to become clogged.

The cold plate is integrally sealed to the stainless steel ice storage bin. Inlet fittings are front serviceable and recessed under the bottom to avoid damage to lines during transportation, installation, removal, refurbishing and storage.

The ice bin door is made of 16-gauge steel to withstand rigorous use. The decorative rim is tough, 16-gauge steel and is removable for easy refurbishing. The drain pan, splash panel and ice bin door are easy to remove without any tools.

The entire exterior bottom of the drop-in is flat, which makes it easier to install, remove and place on pallets for storage and transportation.

In addition to the stainless steel cabinet, durability is enhanced by the stainless steel bin. Extra heavy, 16-gauge stainless steel is used in the critical areas of the valve mount, ice bin door and the removable decorative rim. Stainless steel construction extends the life of the equipment.

An improved drop-in ice dispenser of the present invention has a cabinet with out-turned upper edge portions of front, side and rear walls for supporting the drop-in dispenser on edges of an opening in a counter top. A trim ring overlies and extends outward beyond the out-turned edge portions for covering the out-turned edge portions and the opening in the counter top. A tower with valves extends upward from the cabinet, and anchor portions of the tower extend downward into the cabinet and are connected to the side walls for rigidly supporting the tower. A large curved drain pan extends over the trim ring beneath valves on the tower. A drain pipe connects to the back of the drain pan near the rear tower wall and extends straight downward to a drain opening at the bottom of the dispenser cabinet. The drain tube is straight and uninterrupted and has a large diameter. The base has a channel which extends from the front to the back. An ice storage bin with a cold plate at its bottom is installed in the cabinet. Inlet fittings from the cold plate extend downward and rearward in the channel for ease of connection of liquid lines when the dispenser is tipped on its back, and for preventing damage to the fittings. The ice bin drain and the ice pan drain open in the widened rear of the channel from non-clogging large straight through tubes. A T-shaped smooth plastic runner is mounted in the front center of the base, and two angled inward runners are mounted near rear corners of the base for supporting the unit when moving the unit. Vertical conduit tubes extend upward from the top to the bottom corners of the base for inserting non-cooled syrup lines or electrical lines.

A preferred drop-in dispenser unit apparatus of the present invention has a cabinet, and an ice bin in the cabinet. A cold plate is connected to the ice bin. A tower is mounted above the cabinet and drink dispenser valves are mounted on the tower. A drain pan is mounted beneath the valves. The cabinet has front, back and side walls, with the upper end portions of the walls bent outwardly for supporting the drop-in dispenser on edge portions of an opening in a counter top. A trim ring is connected to the cabinet and extends outward beyond the outward bent upper edge portions of the walls for covering the connection between the outward bent upper edge portions of the walls and the counter top opening.

A base is connected to the cabinet, and a channel extends through the base from the front wall to the rear wall. Inlet fittings are connected to the cold plate and extend downward into the channel and rearward in the channel. The inlet fittings have rearward facing openings for connection to tubes for liquids. The inlet fittings are positioned in the channel near the front wall.

An ice bin drain fitting extends into the channel from the ice bin drain near the rear wall. A pan drain fitting extends into the channel near the rear wall from the drain pan.

The drain pan has a portion which extends rearward beneath the tower to a position near the rear wall. A drain opening in the drain pan is positioned in the rearward extending portion, near the rear wall, and a large, straight drain tube extends from the pan drain to the channel near the rear wall.

Three plastic runners, which are connected to the base, preferably comprise a first angular runner connected to the base near the center of the front wall, and first and second linear runners connected to the base near intersections of the rear wall and side walls and extending at angles to the rear wall and side walls.

The tower extends upward from the cabinet. An anchor portion of the tower extends downward into the cabinet and is connected to side walls of the cabinet for supporting the tower above the cabinet.

The drain pan snaps onto the tower anchors holding the drain pan in place. The splash panel on the front of the tower is easily removed before the drain pan. The door is readily removed after the drain pan. All upper parts are readily removable without tools for thoroughly cleaning those parts and the ice bin and cold plate.

These and further and other objects and features of the invention are apparent in the disclosure, which includes the above and ongoing written specification, with the claims and the drawings.

DETAILED DESCRIPTION OF THE DRAWINGS

Figure 1:
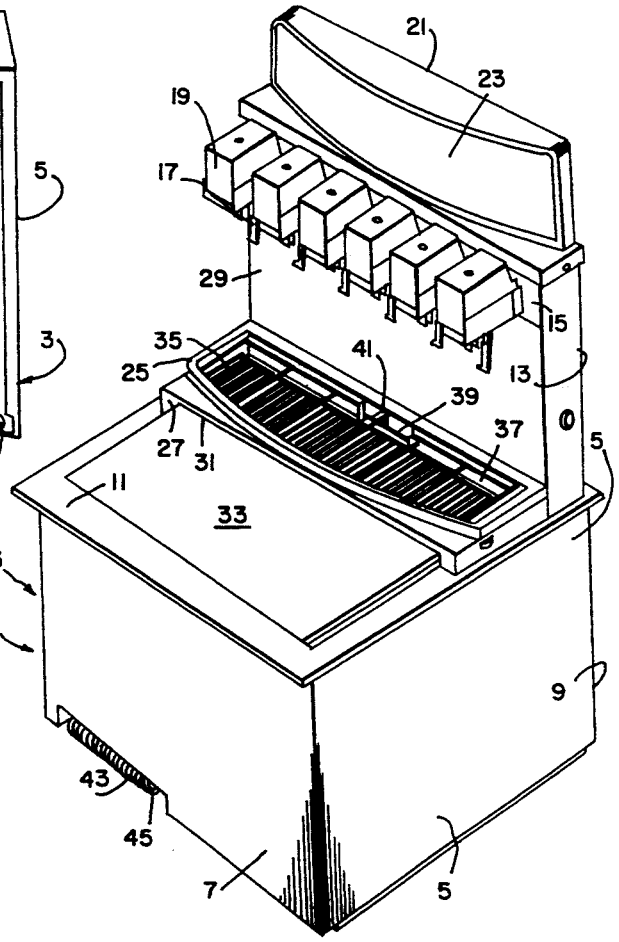
FIG. 1 is a perspective view of the new drop-in dispenser.

Referring to FIG. 1, a beverage and ice dispenser is generally indicated by the numeral 1. The dispenser has a cabinet or box 3 which has side walls 5, a front wall 7 and a rear wall 9. A trim ring 11 covers the top of the cabinet and covers an opening in a counter in which the dispenser is installed. A tower 13 extends upward from the top of the cabinet. The tower has plural dispenser valves 15 arranged in a line along the front. The valves have levers 17 which may be moved to open the valves for mixing carbonated water with flavored syrups to produce the desired soft drinks. Alternatively, the valves may be operated by pushing front faces 19 of the valves.

A large curved merchandiser advertisement 21 appears at the top of the tower. The merchandiser is backlit and has a translucent front panel 23 on which a message appears.

A drain pan 25 below the valve catches overflows from the cups under the valves and ice which is spilled from overfilled cups. The drain pan 25 is mounted on top of the trim ring 11. Lifting up on the front 27 of the drain pan and pulling upward on the drain pan removes the drain pan from the top of the cabinet 3. Lifting or sliding the splash panel 29 upward allows the splash panel to be rocked away from the tower for cleaning. The drain pan 25 has a rectangular opening 31 in its front 27, through which the ice bin door 33 slides or rotates. After the drain pan has been removed, lifting the front edge of the sliding door upward 33 and tilting the door rearward enables the door to be removed from holders at the sides. In that manner, full access is supplied to the ice storage bin for cleaning the bin and the top of the cold plate, which is integral with the bin. The dispenser may be removed from the counter top by lifting upward on the supporting flanges, which are covered by the trim ring 11.

As will be described in greater detail, the tower extends upward above the trim ring and also extends downward into the box 3, where it is anchored for rigidifying the tower and providing a sturdier tower than in the prior art.

The drain pan 25 has a removable screen 35 with large rearward elongated openings 37 to permit dropping of ice below the screen. The screen is supported on parallel fore and aft ridges 39 in the ice pan or on a step around the inside of the pan. Water drains rearward toward the central drain 41. Ribs in the ice pan prevent movement of large pieces of ice toward the drain 41, and prevent blocking of the drain 41 by ice.

The inlet fittings 43 are curved rearward 45 to prevent damage to the fitting.

Figure 2:
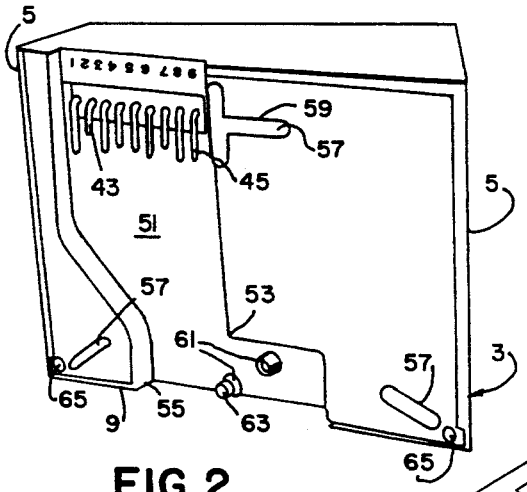
FIG. 2 is a bottom perspective view of the drop-in dispenser shown in FIG. 1.

As shown in FIG. 2, the base 47 has a channel 49 which is offset at one side 51 of the front 7, and which is curved 53 and centered 55 in the rear 9. Channel 49 is an L-shaped channel. The base 47 is plastic, and smooth plastic runners 57 are attached to the base to support the base on a counter, floor or pallet prior to installation.

The three runners prevent rocking. The front runner 59 is T-shaped to provide stability in the forward and sideward directions, and the rear runners 57 are angled and elongated to cooperate with runner 59 in providing directional stability.

The bin drain fitting 61 is located in the wide portion of the channel near the rear wall 9, and the pan drain fitting 63 is also located centrally in the wide portion of the channel near rear wall 9. The base 47 extends downward beneath the drain fittings 61 and 63 and the inlet fittings 43 to protect the fittings against damage. The inlet fittings 43 are positioned near the front wall 47 so that when the box 3 is tipped upward and laid on its rear wall 9, the rearward extending connecting ends 45 of the inlet fittings are readily accessible. The rearward extending fittings hold vulnerable clamps and tube ends within the channel.

Vertical conduits 65 are provided in rear side corners. The conduits extend straight through the container to the top. The conduits may be used for non-cooled syrup lines or electrical lines, specifically, low voltage electrical lines that feed current to the valve solenoid and controlling switches, and electrical lines to the lighting within the merchandiser.

Figure 3:
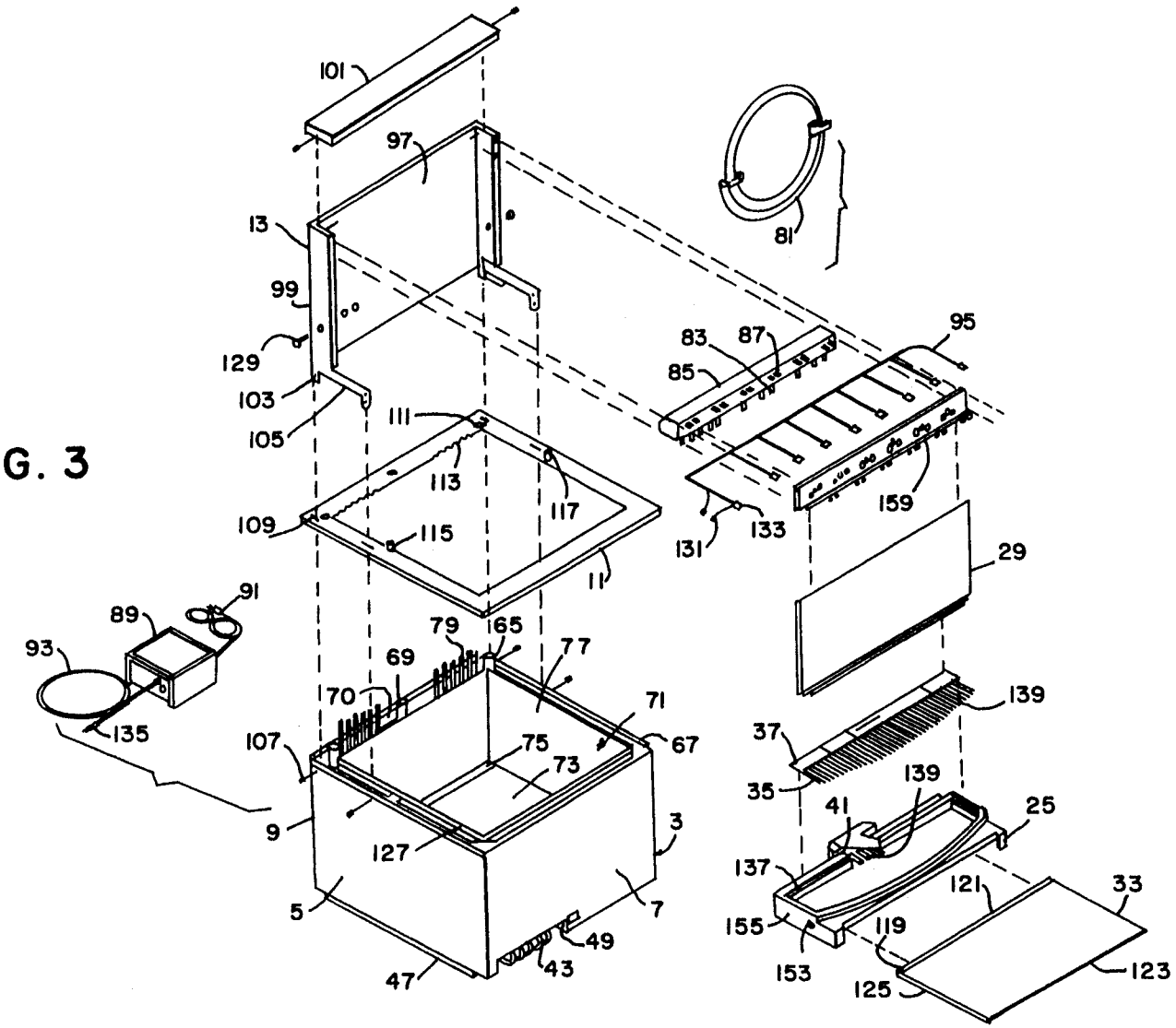
FIG. 3 is an exploded view of the new drop-in dispenser.

Referring to FIG. 3, the cabinet 3 has upper edge portions 67 of side walls 5 and front and rear walls 7 turned outward at 90° for supporting the dispenser on edges of an opening in a counter. The out-turned edges transfer weight directly and uniformly to cabinet walls. Any damage to the out-turned supporting edges is hidden by the trim ring.

A drain tube 69 extends upward through the insulation 70 which surrounds the ice storage bin 71. The base 73 of the ice storage bin is a cold plate 73 which slopes rearward to a drain area 75. The heavy cold plate is sealed and staked to the side walls 77, and rests upon the insulated base 47. Outlets 79 from the cold plate extend upward. Tubes 81 are clamped on the outlets and are connected to inlets 83 of manifold 85. Outlets 87 of the manifold are connected to the mixer valves 15, as shown in FIG. 1. A power supply 89 has an input power cord 91 and a low voltage output power cord 93, which extends upward through one of the conduits 65 and connects with the wiring harness 95, which supplies low voltage power to the solenoid valves 15. The tower 13 is made of a flat back 97 and sides 99, and a cap 101. Legs 103 extend downward from the vertical sides 99 and from stabilizing forward extensions 105 to anchor the tower with bolts 107, which extend through upper portions of side walls 5. The legs 103 extend through slits 109 in the trim ring 11. Alternatively, the trim ring is slotted from its inner edge to receive the anchor legs 103. The trim ring may be slightly raised to expose the outward turned supporting edges 67 of the walls of the cabinet 3. Alternatively, the trim ring may be connected to the out-turned supporting edges 67.

The trim ring 11 has openings 111 for receiving the drain tube 69 and the conduits 65. Slots 113 extending outward from the inner edge of the trim ring receive the pipes 79 extending upward from the cold plate 73. Similar but rectangular slots may receive the anchor legs 103. Lugs 115 extend upward from trim ring 11 and have openings 117 for receiving extensions 119 on the rear edge 121 of the door 33. The rear edge 121 of the door 33 extends upward, and the front edge 123 extends upward, while side edges 125 extend downward to support the door 33 over the upraised collar 127, which is formed around upward extended walls 77 of the ice bin 71. A lock switch 129 is mounted on the side 99 of the tower 13 and is connected to connectors 131 for completing and interrupting the circuit to the wiring harness 95. Connector 133 is connected to connector 135 on the low voltage wire 93. A plugged opening on the other side 99 of tower 13 permits the low voltage wire and switch to be installed on that side.

In the embodiment shown in FIG. 3, the drain pan extends forward over the cover 33. The front edge 123 of the cover 33 is raised to provide access to the ice bin 71. Where permitted, the pivots 119 are disengaged from the holes 117 in lugs 115, and the cover 33 is permitted to slide rearward and forward under the drain pan 25.

The drain pan 25 has a recessed lip 137 on which the peripheral wire 139 of screen 35 rests. Raised ribs 139 on the bottom of the drain pan permit water to flow rearward, but prevent ice from flowing rearward to block the drain opening 41 at the rear of the drain pan. The drain opening 41 is connected to drain tube 69.

Figure 4:
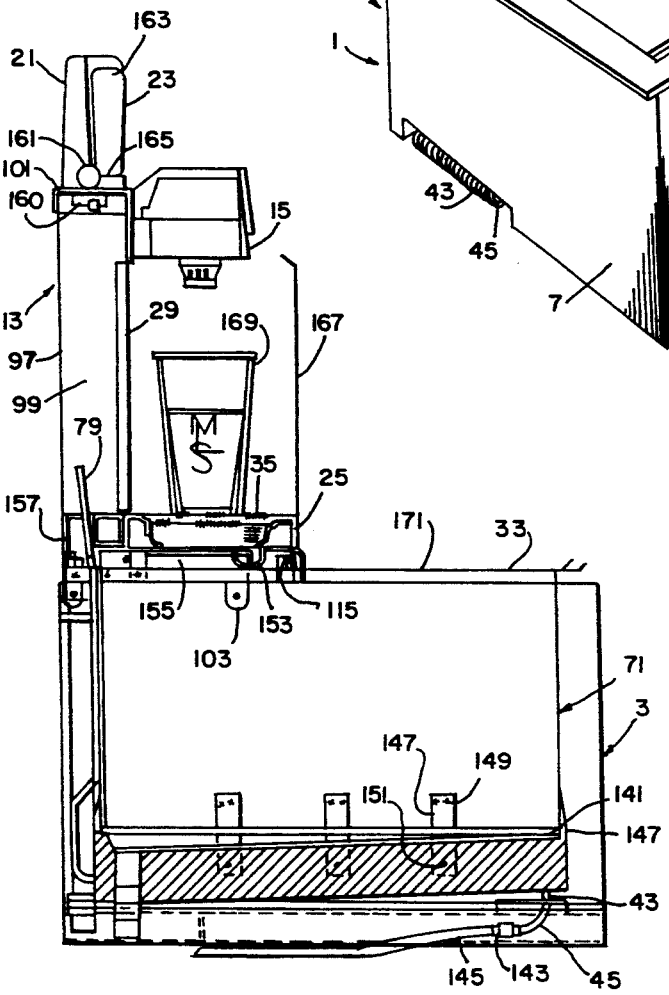
FIG. 4 is a side elevation schematic view of the new drop-in dispenser.

As shown in FIG. 4, walls 77 of the ice bin 71 are sealed within a groove 141 in the top of the ice plate 73. Ends 45 of the inlets are clamped 143 to flexible syrup and soda water tubes 145. The side walls are staked as well as sealed to the cold plate with straps 147, which are spot welded 149 to the walls 77, and which are nailed 151 to the cold plate.

As shown in FIG. 4, a spring clip 153 in the side 155 of the drip pan 25 engages the front corner of extension 105 to hold the front of the drip pan. The rear 157 of the drip pan is held in place by engagement of the drain 41 with the drain tube 69, and the splash panel 29 is held in place by engagement with the drain pan 25 and the screen 35 and the valve mounting panel 159.

In one embodiment, the merchandiser 21 is held by the cap 101. The merchandiser includes a transformer 160 and a fluorescent lamp 161, which backlights a translucent printed panel 23 held between upper and lower rims 163 and 165.

The cover 33 is rotated upward to the position 167 as shown in FIG. 4 to obtain a scoop of ice from the bin 71. The ice is dropped into the cup 169, and the cover 33 is closed before the mixture of syrup and soda water is dispensed from valve 15. Alternatively, where permitted, the cover may be slid rearward to the position 171 of the front edge, as shown in FIG. 4.

While the invention has been described with reference to specific embodiments, modifications and variations of the invention may be constructed without departing from the scope of the invention, which is defined in the following claims.

I claim:

1. A drop-in dispenser unit apparatus comprising a cabinet, an ice bin in the cabinet, a cold plate connected to the ice bin, a tower mounted above the cabinet, drink dispenser valves mounted on the tower, a drain pan mounted beneath the valves, the cabinet having front, back and side walls with the upper end portions of the walls bent outwardly for supporting the drop-in dispenser on edge portions of an opening in a counter top and a trim ring connected to the cabinet and extending outward beyond the outward bent upper edge portions of the walls for covering the connection between the outward bent upper edge portions of the walls and the counter top opening, further comprising a base connected to the cabinet, and a channel extending through the base from the front wall to the rear wall, inlet fittings connected to the cold plate and extending downward into the channel and extending rearward in the channel and having rearward facing openings for connection to tubes for liquids.

2. The apparatus of claim 1, wherein the inlet fittings are positioned in the channel near the front wall.

3. The apparatus of claim 2, further comprising an ice bin drain extending into the channel from the ice bin near the rear wall and a pan drain extending into the channel near the rear wall from the drain pan.

4. The apparatus of claim 3, wherein the drain pan has a portion which extends rearward beneath the tower to a position near the rear wall, and wherein a drain in the drain pan is positioned in the rearward extending portion, near the rear wall, and wherein a straight drain tube extends from the pan drain to the channel near the rear wall.

5. The apparatus of claim 1, further comprising plastic runners connected to the base.

6. The apparatus of claim 5, wherein the three plastic runners comprise a first angular runner connected to the base near the center of the front wall, and first and second linear runners connected to the base near intersections of the rear wall and side walls and extending at angles to the rear wall and side walls.

7. A drop-in dispenser unit apparatus comprising a cabinet, an ice bin in the cabinet, a cold plate connected to the ice bin, a tower mounted above the cabinet, drink dispenser valves mounted on the tower, a drain pan mounted beneath the valves, the cabinet having front, back and side walls with the upper end portions of the walls bent outwardly for supporting the drop-in dispenser on edge portions of an opening in a counter top and a trim ring connected to the cabinet and extending outward beyond the outward bent upper edge portions of the walls for covering the connection between the outward bent upper edge portions of the walls and the counter top opening, wherein the tower extends upward from the cabinet, and further comprising an anchor portion of the tower extending downward into the cabinet and connected to side walls of the cabinet for supporting the tower above the cabinet.

8. A drop-in dispenser unit apparatus comprising a cabinet, an ice bin in the cabinet, a cold plate connected to the ice bin, a tower mounted above the cabinet, drink dispenser valves mounted on the tower, a drain pan mounted beneath the valves, the cabinet having front, back and side walls, a base connected to the cabinet, and a channel extending through the base from the front wall to the rear wall, inlet fittings connected to the cold plate and extending downward into the channel and extending rearward in the channel and having rearward facing openings for connection to tubes for liquids.

9. The apparatus of claim 8, wherein the inlet fittings are positioned in the channel near the front wall.

10. The apparatus of claim 9, further comprising an ice bin drain extending straight into the channel from the ice bin near the rear wall and a pan drain tube fitting extending into the channel near the rear wall from the drain pan.

11. The apparatus of claim 10, wherein the drain pan has a portion which extends rearward beneath the tower to a position near the rear wall, and wherein a drain in the drain pan is positioned in the rearward extending portion, near the rear wall, and wherein a straight drain tube extends from the pan drain to the drain tube fitting in the channel near the rear wall.

12. The apparatus of claim 8, further comprising plastic runners connected to the base.

13. The apparatus of claim 12, wherein the plastic runners comprise a first angular runner connected to the base near the center of the front wall, and first and second linear runners connected to the base near intersections of the rear wall and side walls and extending at angles to the rear wall and side walls.

14. The apparatus of claim 8, wherein the tower extends upward from the cabinet, and further comprising an anchor portion of the tower extending downward into the cabinet and connected to side walls of the cabinet for supporting the tower above the cabinet.

15. The apparatus of claim 8, wherein upper portions of the cabinet walls are bent outwardly for supporting the drop-in dispenser on edge portions of an opening in a counter top, and further comprising a trim ring connected to the cabinet and extending outward beyond the outward bent upper edge portions of the cabinet walls for covering a connection between the outward bent upper edge portions of the walls and the counter top opening.

16. A drop-in dispenser unit apparatus comprising a cabinet, an ice bin in the cabinet, a cold plate connected to the ice bin, a tower mounted above the cabinet, drink dispenser valves mounted on the tower, a drain pan mounted beneath the valves, the cabinet having front, back and side walls, wherein the tower extends upward from the cabinet, and further comprising an anchor portion of the tower extending downward into the cabinet and connected to side walls of the cabinet for supporting the tower above the cabinet.

17. The apparatus of claim 16, wherein the anchor portion comprises forward extensions on sides of the tower at bottom portions of the sides, legs extending downward of the forward extensions and from the sides of the tower, and fasteners extending through side walls of the cabinet and the legs.

18. The apparatus of claim 17, further comprising a trim ring overlying the cabinet and having openings for receiving the legs.

19. The apparatus of claim 16, wherein the drain pan has clips for frictionally engaging the forward extensions and holding the drain pan in place, and further comprising a splash panel connected to a top of the tower and connected to the drain pan for holding the splash panel in place, wherein the drain pan has a frontal opening, and further comprising an ice bin cover having a rear edge mounted within the drain pan opening, the drain pan, splash panel and ice bin cover being readily removable without tools for cleaning the pan panel and cover and the ice bin and the cold plate.

* * * * *